US008638351B2

(12) United States Patent
Yamada et al.

(10) Patent No.: US 8,638,351 B2
(45) Date of Patent: Jan. 28, 2014

(54) THERMAL PRINTER AND ENERGIZING CONTROL METHOD THEREFOR

(75) Inventors: Koji Yamada, Okaya (JP); Hitoshi Ishino, Shimosuwa-machi (JP)

(73) Assignee: Seiko Epson Corporation, Tokyo (JP)

( * ) Notice: Subject to any disclaimer, the term of this patent is extended or adjusted under 35 U.S.C. 154(b) by 32 days.

(21) Appl. No.: 13/505,603

(22) PCT Filed: Oct. 26, 2010

(86) PCT No.: PCT/JP2010/068989

§ 371 (c)(1),
(2), (4) Date: May 2, 2012

(87) PCT Pub. No.: WO2011/052603

PCT Pub. Date: May 5, 2011

(65) Prior Publication Data

US 2012/0218366 A1 Aug. 30, 2012

(30) Foreign Application Priority Data

Nov. 2, 2009 (JP) ..... 2009-251746

(51) Int. Cl.
*B41J 2/00* (2006.01)

(52) U.S. Cl.
USPC ..... 347/194

(58) Field of Classification Search
USPC ..... 347/188, 189, 191, 194, 196, 171
See application file for complete search history.

(56) References Cited

U.S. PATENT DOCUMENTS

| | | | | |
|---|---|---|---|---|
| 5,608,442 | A * | 3/1997 | Bennefeld et al. | 347/191 |
| 6,377,290 | B1 * | 4/2002 | Amiya et al. | 347/194 |
| 7,319,473 | B2 * | 1/2008 | Wiens | 347/188 |
| 7,542,060 | B2 * | 6/2009 | Koyabu et al. | 347/196 |

FOREIGN PATENT DOCUMENTS

| | | | |
|---|---|---|---|
| JP | 3-109842 | U | 11/1991 |
| JP | 07-025052 | A | 1/1995 |
| JP | 07-137327 | A | 5/1995 |
| JP | 07-227990 | A | 8/1995 |
| JP | 08-118704 | A | 5/1996 |
| JP | 11-048510 | A | 2/1999 |
| JP | 11-268317 | A | 10/1999 |
| JP | 2005-040971 | A | 2/2005 |
| JP | 2005-231180 | A | 9/2005 |
| JP | 2005-313481 | A | 11/2005 |
| JP | 2007-055239 | A | 3/2007 |

OTHER PUBLICATIONS

International Preliminary Report on Patentability dated Jun. 21, 2012 for Application No. PCT/JP20101068989.
International Search Report Application No. PCT/JP2010/068989, Oct. 2010.

* cited by examiner

*Primary Examiner* — Kristal Feggins
(74) *Attorney, Agent, or Firm* — Nutter McClennen & Fish LLP; John J. Penny, V.

(57) ABSTRACT

A thermal printer having a thermal head with a heat element that heats a recording medium and forms a print dot by energizing the heat element generates a first energizing pulse that energizes continuously during a first period for forming a print dot when the recording medium conveyance speed is greater than a specific threshold value; and generates a second energizing pulse that alternates during the first period between energizing for a second period that is shorter than the first period and de-energizing for a third period when the recording medium conveyance speed is less than or equal to the threshold value.

7 Claims, 3 Drawing Sheets

THERMAL PRINTER AND ENERGIZING CONTROL METHOD THEREFOR

TECHNICAL FIELD

The present invention relates to a thermal printer that forms print dots on recording paper by energizing and heating the heat elements of a thermal printhead, and to an energizing control method therefor.

RELATED ART

Thermal printers that convey thermal paper or other recording paper between a thermal head and a platen roller, and energize and heat the heat elements of the thermal head to produce color and form print dots where the recording paper contacts the heat elements, control energizing the heat elements at the print dot positions synchronized to conveyance of the recording paper, and thereby control the heating temperature and the time heat is applied to the print dot formation position to form print dots of the desired size.

A thermal printer that considers the effect of speed variations to control energizing the thermal head when the conveyance speed of the recording paper (the printing speed) varies according to various parameters is described in Patent Reference 1. Patent Reference 1 describes determining the energizing time with consideration for cooling during the de-energized time because the de-energized time between print dots increases compared with printing at normal speed when the thermal head is energized while printing at low speed. More specifically, in order to reduce excessive heat buildup resulting from continuous energizing when print dots are formed continuously, the heating time is reduced for the print dots that are formed later, and this time reduction is reduced during low-speed printing.

PRIOR ART REFERENCES

Patent Documents

Patent Reference 1: Japan Patent No. 2007-55239

SUMMARY OF INVENTION

Problem to be Solved by the Invention

When printing with a low recording paper (thermal paper) conveyance speed, a phenomenon called "sticking" in which the color coating on the thermal paper melts and sticks to the thermal head can occur. When sticking occurs, print quality drops because normal paper conveyance is inhibited and the paper conveyance speed can vary.

With consideration for this problem, an object of the present invention is to provide a thermal printer and energizing control method therefor that can reduce sticking during low speed printing and improve print quality.

Means of Solving the Problem

To solve the foregoing problem, an energizing control method according to the invention for a thermal printer having a thermal head with a heat element that heats a recording medium and forms a print dot by energizing the heat element is characterized by: generating a first energizing pulse that energizes continuously during a first period for forming a print dot when the recording medium conveyance speed is greater than a specific threshold value; and generating a second energizing pulse that alternates during the first period between energizing for a second period that is shorter than the first period and de-energizing for a third period when the recording medium conveyance speed is less than or equal to the threshold value.

By energizing intermittently during a first period during so-called low speed printing, heat output can be suppressed while the heat elements heat the recording medium, and the heat elements can be prevented from overheating. The heat elements being heated can therefore be held at an appropriate temperature, and the color coating on the surface of the recording medium can be prevented from being melted by a high temperature heat element. A drop in print quality due to sticking can therefore be reduced.

At least one of the second period and the third period in the second energizing pulse can also be varied according to at least one of the print dot density and the ambient temperature of the thermal head. Because heat output can be adjusted by increasing or decreasing the de-energized time in this configuration, the heating temperature can be adjusted to an appropriate range and print quality can be improved.

Alternatively, the second period may be held constant and the third period varied in the second energizing pulse.

Alternatively, the second energizing pulse may be generated by signal chopping.

Another aspect of the invention is a thermal printer having a thermal head with a heat element; a conveyance means that conveys a recording medium passed a position opposite the thermal head; and a control means that heats the recording medium and forms a print dot by energizing the heat element; wherein the control means generates a first energizing pulse that energizes continuously during a first period for forming a print dot when the conveyance speed of the recording medium by means of the conveyance means is greater than a specific threshold value, and generates a second energizing pulse that alternates during the first period between energizing for a second period that is shorter than the first period and de-energizing for a third period when the conveyance speed is less than or equal to the threshold value.

The printer may also have an adjustment means that changes at least one of the second period and the third period in the second energizing pulse according to at least one of the print dot density and the ambient temperature of the thermal head. This configuration enables the user to change the settings appropriately according to the required quality.

The control means may also be configured to generate the second energizing pulse by signal chopping.

DESCRIPTION OF EMBODIMENTS

A preferred embodiment of a thermal printer according to the invention is described in detail below with reference to the accompanying figures.

General Configuration

Figure 1:
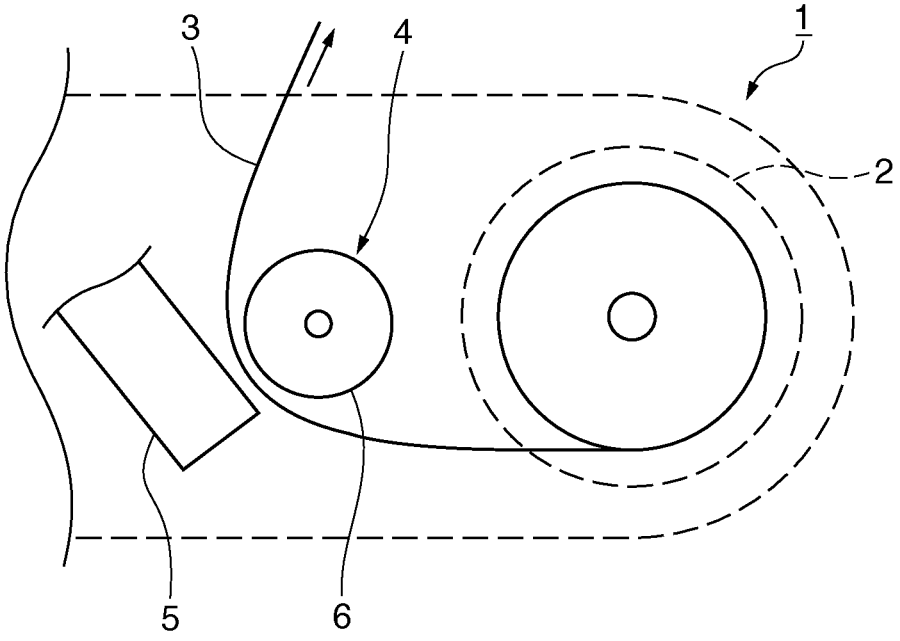
FIG. 1 schematically describes a thermal printer according to a preferred embodiment of the invention.

As shown in FIG. 1, the thermal printer 1 has a roll paper compartment 2 for storing roll paper, which is continuous recording paper wound in a roll, a recording paper conveyance mechanism 4 (conveyance means) that conveys recording paper 3 delivered from the paper roll stored in the roll paper compartment 2 through a conveyance path inside the printer, and a thermal head 5 that is disposed with the heating part facing the printing position of the conveyance path. Continuous thermal paper or label paper having labels made of thermal paper affixed to a continuous liner, for example, is used as the recording paper 3.

The recording paper conveyance mechanism 4 includes a platen roller 6 disposed opposite the thermal head 5, and a conveyance motor not shown that drives the platen roller 6. The recording paper 3 delivered from the paper roll is loaded so that it passes between the thermal head 5 and platen roller 6, and the recording paper 3 is conveyed in conjunction with rotation of the platen roller 6 contacting the recording paper 3.

A plurality of heat elements are disposed to the thermal head 5 in an array widthwise to the recording paper 3 opposite the platen roller 6. When the heat elements are pressed to the recording paper 3 held between the thermal head 5 and platen roller 6 and a specific voltage is then applied causing a specific heat element to heat, the part of the recording paper 3 touching the energized heat element is heated and changes color, and a print dot is formed. A thermistor or other temperature sensor 7 (see FIG. 2) is disposed to the thermal head 5 for detecting the nearby ambient temperature.

The thermal head 5 can independently drive and heat each of the heat elements, and selectively drives the heat elements corresponding to the positions where dots are to be printed according to the pixel data for each dot line in the print data. As a result, a row of print dots corresponding to the pixel data for each dot line in the print data is formed simultaneously on the recording paper 3. The thermal printer 1 prints on the recording paper 3 by rotating the platen roller 6 and conveying the recording paper 3 synchronized to the printing operation of each dot line.

Figure 2:
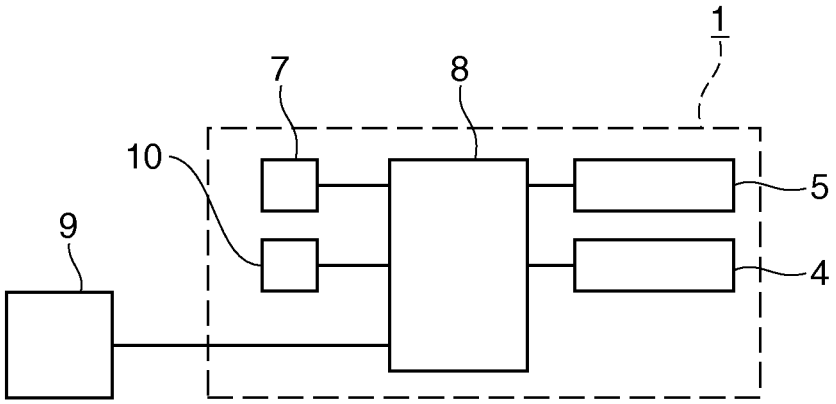
FIG. 2 is a control block diagram of the thermal printer shown in FIG. 1.

As shown in FIG. 2, the control unit 8 (control means) of the thermal printer 1 includes a CPU, ROM, and RAM. Software (firmware) and data for rendering various functions of the thermal printer 1 are stored in ROM, and various thermal printer 1 functions are performed as a result of the CPU reading and executing these. RAM functions as a temporary storage device for data that is required to implement thermal printer 1 functions. In addition to these parts rendering the control unit 8, a communication interface, motor driver for controlling the conveyance motor, and integrated circuits (gate array) for driving the thermal head 5, are disposed to a control circuit board inside the thermal printer 1.

The control unit 8 is connected through the communication interface to a host computer or other host device 9, and print data and control commands are sent from the host device 9 to the control unit 8. Detection signals from various sensors such as the temperature sensor 7 are also input to the control unit 8.

Controlling Energizing the Thermal Head

Figure 3:
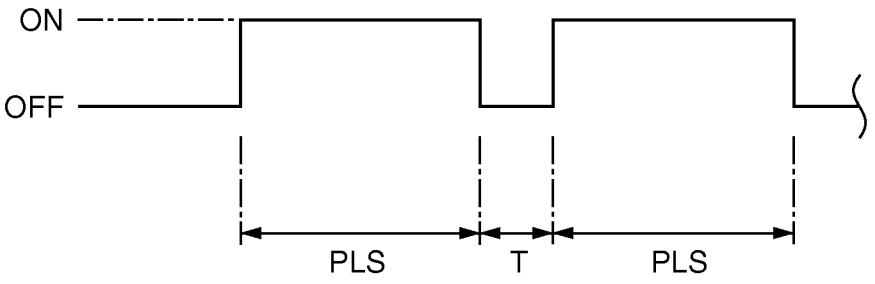
FIG. 3 is a timing chart of the energizing control signal (strobe signal) applied to the heat element drive circuit during high speed printing.
Figure 4:
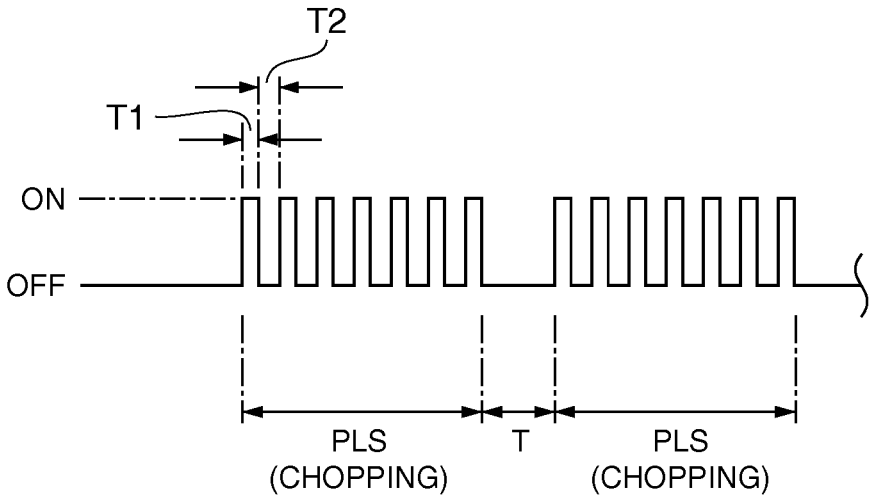
FIG. 4 is a timing chart of the energizing control signal (strobe signal) applied to the heat element drive circuit during low speed printing.

FIG. 3 shows an energizing control signal (strobe signal) applied to the drive circuits of the heat elements of the thermal head during high speed printing, and FIG. 4 shows an energizing control signal (strobe signal) applied to the drive circuits of the heat elements of the thermal head during low speed printing. A specific voltage is applied to the drive circuit and the heat element is energized when the strobe signal is ON, and energizing stops when the strobe signal is OFF. The voltage applied when the strobe signal is ON is constant.

As shown in FIG. 3, when the recording paper conveyance speed is high, a strobe signal that remains continuously ON during the energizing period PLS (first period) for forming one print dot is supplied, and energizing is continuous during this period. When the recording paper conveyance speed is slow, a strobe signal that is divided into short pulses is supplied as shown in FIG. 4, and signal chopping applying short energizing pulses continues throughout the entire energizing period PLS. Energizing by means of signal chopping alternates between short energizing periods constituting the energizing pulses (chopping-ON period T1; second period), and de-energized periods (chopping-OFF period T2; third period) between the energizing periods.

The recording paper conveyance speed used as the threshold for continuous energizing or signal chopping can be desirably set, and can be set to 60 mm/sec, for example. The control unit 8 controls energizing as shown in FIG. 4 when the recording paper conveyance speed during print dot formation is less than or equal to this threshold value. More specifically, the control unit 8 determines the recording paper conveyance speed at certain times during the printing operation by detecting the speed of the conveyance motor of the recording paper conveyance mechanism 4, determines if the detected recording paper conveyance speed is less than or equal to the threshold speed, and based on the result of this decision determines whether or not to use signal chopping.

The energizing period PLS (first period) is an energizing period that determines how long the heat element is held in contact with and heats the print dot formation position of the recording paper 3. A specific energizing pause T is provided between the end of the energizing period PLS forming one print dot and the start of the energizing period PLS forming the next print dot. The length of the energizing period PLS is determined according to the recording paper conveyance speed, is short during high speed printing, and is long during low speed printing. The ratio between the energizing period PLS and de-energized time T can be set desirably.

The length of and ratio between the chopping-ON period T1 (second period) and the chopping-OFF period T2 (third period) are set in advance to suitable values. In this embodiment of the invention the chopping-ON period T1 is set to a constant value, and remains constant under all printing conditions and print settings. The chopping-OFF period T2, however, can be adjusted by operating a DIP switch 10 (adjustment means, see FIG. 2) disposed to the thermal printer 1. The user can operate the DIP switch 10 and change the ON time of the energizing pulses. This enables changing the total energizing time of the energizing period PLS, thereby changing the heat output and the heating temperature of the recording paper 3 when forming a print dot, and adjusting the print dot density.

A print density setting command can also be sent from the host device 9 to the control unit 8, and the chopping-OFF period T2 setting can be changed based on this print density setting command. A print density command can also be included in the print data, and the print density can be adjusted accordingly while printing.

As described above, this embodiment of the invention uses signal chopping throughout the energizing period PLS (first period) that heats the recording paper 3 and forms print dots by means of the heat elements of the thermal head 5 during low speed printing, and can thereby prevent the heat elements from overheating during low speed printing. Sticking can therefore be reduced and loss of print quality can be prevented.

Other Embodiments (1) The embodiment described above adjusts the chopping-OFF period T2 based on the print density, but could use other parameters instead of or in addition to the print density. For example, the chopping-OFF period T2 setting can be changed based on the ambient temperature of the thermal head 5 detected by the temperature sensor 7. Because this enables adjusting heat output according to the ambient temperature, the heating temperature of the recording paper 3 can always be held to a suitable temperature. The chopping-OFF period T2 can also be adjusted according to the type of recording paper 3 to accommodate differences in sticking conditions due to the type of recording paper 3. Further alternatively, the chopping-OFF period T2 may be adjusted according to such characteristics as the voltage applied when energizing the heat elements and the heat storage characteristic of the thermal head 5. The chopping-OFF period T2 may also be adjusted according to the recording paper conveyance speed. For example, the chopping-OFF period could be increased as the recording paper conveyance speed decreases.

(2) The chopping-ON period T1 is constant and the chopping-OFF period T2 is adjustable based on various parameters in the embodiment described above, but both the chopping-ON period T1 and chopping-OFF period T2 could be variable. For example, both the chopping-ON period T1 and chopping-OFF period T2 could be shortened as the recording paper conveyance speed decreases. Changing only the chopping-ON period T1 instead of changing the chopping-OFF period T2 based on various parameters is also conceivable.

(3) The threshold speed for determining whether to use signal chopping or continuous energizing is 60 mm/sec in the foregoing embodiment, but this value can be suitably changed according to the type of recording paper 3 and the ambient temperature of the thermal head 5, for example.

This application is based upon Japanese Patent Application 2009-251746 filed on Nov. 2, 2009, the entire contents of which are incorporated by reference herein.

The invention claimed is:

1. An energizing control method for a thermal printer having a thermal head with a heat element that heats a recording medium and forms a print dot by energizing the heat element, comprising:

generating a first energizing pulse that energizes continuously during a first period for forming a print dot when the recording medium conveyance speed is greater than a specific threshold value; and generating a second energizing pulse that alternates during the first period between energizing for a second period that is shorter than the first period and de-energizing for a third period when the recording medium conveyance speed is less than or equal to the threshold value.

2. The energizing control method described in claim 1, further comprising:

enabling varying at least one of the second period and the third period in the second energizing pulse according to at least one of the print dot density and the ambient temperature of the thermal head.

3. The energizing control method described in claim 2, further comprising:

holding the second period constant and varying the third period in the second energizing pulse.

4. The energizing control method described in claim 1, further comprising:

generating the second energizing pulse by signal chopping.

5. A thermal printer comprising:

a thermal head with a heat element;

a conveyance means that conveys a recording medium passed a position opposite the thermal head; and a control means that heats the recording medium and forms a print dot by energizing the heat element;

wherein the control means generates a first energizing pulse that energizes continuously during a first period for forming a print dot when the conveyance speed of the recording medium by means of the conveyance means is greater than a specific threshold value, and generates a second energizing pulse that alternates during the first period between energizing for a second period that is shorter than the first period and de-energizing for a third period when the conveyance speed is less than or equal to the threshold value.

6. The printer described in claim 5, further comprising:

an adjustment means that changes at least one of the second period and the third period in the second energizing pulse according to at least one of the print dot density and the ambient temperature of the thermal head.

7. The printer described in claim 5, wherein:

the control means generates the second energizing pulse by signal chopping.

* * * * *